US005156007A

United States Patent [19]

Bartlett et al.

[11] Patent Number: 5,156,007

[45] Date of Patent: Oct. 20, 1992

[54] CRYOPUMP WITH IMPROVED SECOND STAGE PASSAGEWAY

[75] Inventors: Allen J. Bartlett, Milford; Philip A. Lessard, Boxborough; Stephen J. Yamartino, Wayland; John T. Harvell, Sudbury, all of Mass.

[73] Assignee: Helix Technology Corporation, Mansfield, Mass.

[21] Appl. No.: 647,848

[22] Filed: Jan. 30, 1991

[51] Int. Cl.[5] ..... B01D 8/00

[52] U.S. Cl. ..... 62/55.5; 55/269; 417/901

[58] Field of Search ..... 62/55.5, 100, 268; 55/269; 417/901

[56] References Cited

U.S. PATENT DOCUMENTS

| | | | |
|---|---|---|---|
| 4,356,701 | 11/1982 | Bartlett et al. | 62/55.5 |
| 4,449,373 | 5/1984 | Peterson et al. | 62/55.5 |
| 4,479,360 | 10/1984 | Bachler et al. | 62/55.5 |
| 4,514,204 | 4/1985 | Bonney et al. | 62/55.5 |
| 4,546,613 | 10/1985 | Eacobacci et al. | 62/55.5 |
| 4,555,907 | 12/1985 | Bartlett | 62/55.5 |
| 4,611,467 | 9/1986 | Peterson | 62/55.5 |
| 4,815,303 | 3/1989 | Duza | 62/55.5 |
| 4,838,035 | 6/1989 | Carlson et al. | 62/55.5 |

FOREIGN PATENT DOCUMENTS

| | | |
|---|---|---|
| 379992 | 8/1990 | European Pat. Off. . |
| 60-6086 | 1/1985 | Japan . |
| 264345 | 4/1990 | Japan . |

*Primary Examiner*—Ronald C. Capossela

*Attorney, Agent, or Firm*—Hamilton, Brook, Smith & Reynolds

[57] ABSTRACT

Condensation on a cryopump second stage refrigerator cylinder is prevented by arranging a passageway between a colder second stage cylinder shield in thermal contact with the coldest section of the second stage and a warmer radiation shield in thermal contact with the warmer first stage. This arrangement produces a uniform and significant temperature differential in the passageway. The passageway is arranged so that the ratio of its length, L, to its width, W, is ideally greater than five. This ensures molecular collisions with the cold surface of the cylinder shield so that gas molecules are tightly bound to the cylinder shield. As a result, condensation on the refrigerator cylinder and resultant pressure variations are prevented.

11 Claims, 5 Drawing Sheets

CRYOPUMP WITH IMPROVED SECOND STAGE PASSAGEWAY

BACKGROUND OF THE INVENTION

Cryopumps cooled by two stage closed cycle coolers are used to create a vacuum in a work chamber. When cryopumps are used to create a vacuum in a sputtering system where the process is carried out in an argon, oxygen or nitrogen environment, a common problem is "argon hang up". "Argon hang up" occurs when a valve between the work chamber and the cryopump is opened to expose the very high vacuum cryopump to a lower vacuum work chamber. To achieve a work chamber vacuum pressure of $10^{-7}$ torr, argon gas must be condensed on the cold second stage array at a temperature of 10 to 20K. If any argon gas pumps on the first stage array, sublimation from the frontal array causes the pressure in the system to "hang up" at a higher pressure.

A problem related to "argon hang up" can occur as a result of condensation of gases on the side of the second stage refrigerator cylinder. This problem is particularly apparent where an open second stage array is used to provide for maximum flow to an adsorbent material on the back side of the array. At normal operating temperatures, there is a temperature gradient along the length of the refrigerator cylinder from the approximately 77K first stage heat sink to the 15K second stage heat sink. Argon and other gases can condense along a zone of the refrigerator cylinder which is at a temperature of less than 50K. The temperature of that zone is determined by the system pressure. When a thermal load is applied to the first stage, as by opening a valve in the system, the first stage temperature increases and shifts the 50K zone along the length of refrigerator cylinder. As that zone shifts, gas which had been frozen out on the cylinder is rapidly liberated. That rapid evaporation results in a sharp increase in the work chamber pressure. Further, even when the thermal load on the first stage is constant, a displacer within the refrigerator cylinder reciprocates and causes continuous movement of the critical zone. That movement of the critical zone results in a high frequency fluctuation of the pressure in the work chamber.

U.S. Pat. No. 4,546,613 to Eacobacci et al. presents solutions to hangup. To avoid the problems caused by condensation of argon and other gases on the second stage refrigerator, a close fitting sleeve or shield surrounds the refrigerator cylinder. That sleeve or shield is in thermal contact with the second stage heat sink but is not in contact with the refrigerator cylinder. Most gas which passes the second stage array is condensed on the shield before it reaches the cylinder. A narrow gap of about 0.1 inch or less between the shield and warmer first stage array surfaces prevents gas from accessing the cylinder surfaces due to condensation in the gap. The gap is ideally controlled to a $1/w \geqq 5$ in order to insure multiple gas surface collisions and therefore maximize condensation on the shield. With the shield held at the low temperature of the second stage heat sink, gas which condenses on the shield is held there and does not subsequently evaporate with displacer motion or high heat load to the first stage.

SUMMARY OF THE INVENTION

The Eacobacci et al. system served well with process operating pressures of $10^{-3}$ torr and recovery pressures between process runs as low as $10^{-6}$ torr. However, in a new generation of clustered process chambers, lower recovery pressures of $10^{-8}$ torr or less are required to assure cleanliness and, thus, prevent interchamber contamination. Processing pressures of $10^{-3}$ torr are still typical. The cryopump system must thus be able to recover from $10^{-3}$ torr to $10^{-8}$ torr in seconds. The Eacobacci et al. system would hang up at $10^{-6}$ torr. Thus, further steps must be taken to ensure that no gas condenses on the cylinder and subsequently evaporates.

In accordance with the principles of this invention, condensation on a second stage refrigerator cylinder in a cryopump is avoided by a cryopump shield. The cryopump shield comprises a second stage cylinder shield in thermal contact with the colder second stage and an opposing surface in thermal contact with the warmer first stage so that a passageway is formed between the cylinder shield and the opposing surface. The length, L, of the passageway and the width, W, of the passageway are arranged so that the ratio of the length of the passageway to the width of the passageway is sufficient to capture virtually any gas passing therethrough and is preferably greater than five. This ensures that the gas molecules which enter the passageway will collide with the cold surface of the cylinder shield and condense on the cylinder shield. By thermally coupling the second stage cylinder shield to the coldest portion of the second stage and thermally coupling the opposing surface to the warmer first stage, a significant temperature differential is created in the passageway. This temperature differential is greater than that achieved in prior art devices. Moreover, the temperature differential in the passageway of the invention is more uniform than previously achieved. At pressures below $10^{-4}$ torr, the gas flow will be molecular; large mean free paths of molecules before molecular collisions ensure that the flow is dominated by molecular collisions with the walls. The long narrow passageway ensures multiple molecular bounces before collision with the second stage refrigerator cylinder. The higher temperature of the opposing surface in the passageway minimize short term capture on that surface and forces the gas molecule to the cold second stage surface where it is tightly bound and from which the gas will not be released. Thus, gas molecules are prevented from condensing on the second stage, particularly the second stage refrigerator cylinder, so subsequent sublimation from the second stage (and the resultant pressure fluctuation) is prevented and vacuum pressures are achieved and maintained.

In a preferred embodiment, an annular passageway in a flat pump is formed between the flared end of the cylinder shield and a cup which is attached to the radiation shield. Both the flared end of the cylinder shield and the cup are concentric with the refrigerator cylinder. In another embodiment, the passageway is formed by a flared end of the cylinder shield (which extends transverse to the body of the cylinder shield) and the radiation shield. The flared cylinder shield thus extends parallel to the radiation shield.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 1(*a*) illustrates a molecular bounce path in the passageway of FIG. 1.

PREFERRED EMBODIMENT OF THE INVENTION

The cooling process in the refrigerator of a typical cryopump is analogous to the cooling process in a household refrigerator. In a household refrigerator, the working fluid, freon gas, is compressed, the heat of compression removed by air-cooled heat exchangers, and the gas is then expanded to produce cooling below the ambient temperature. By comparison, a cryopump must operate effectively at less than 20K to remove gas molecules from a working chamber. This low temperature requires the use of highly efficient heat exchangers and a working fluid (helium gas) that remains fluid at temperatures approaching absolute zero.

The flow of helium in the cryogenic refrigerator of a cryopump is cyclic. In its most basic form, a source of compressed gas, i.e., a compressor, is connected to a first end of a cylinder through an inlet valve. An exhaust valve in an exhaust line leads from the first end to the low-pressure side of the compressor. With a regenerator piston at a second end of the cylinder, and with the exhaust valve closed and the inlet valve open, the cylinder fills with compressed gas. With the inlet valve still open, the piston moves to the first end to force compressed gas through the regenerator to the second end, the gas being cooled as it passes through the regenerator. When the inlet valve is closed and the exhaust valve is opened, the gas expands into the low-pressure discharge line and cools further. The resulting temperature gradient across the cylinder wall at the second end causes heat to flow from the load into the gas within the cylinder. With the exhaust valve opened and the inlet valve closed, the piston is then moved to the second end, displacing gas back through the regenerator which returns heat to the cold gas, and the cycle is completed.

To produce the low temperatures required for cryopump uses, the incoming gas must be cooled before expansion. The regenerator extracts heat from the incoming gas, stores it, and then releases it to the exhaust stream. A regenerator is a reversing-flow heat exchanger through which the helium passes alternatively in either direction. It is comprised of a material of high surface area, high specific heat, and low thermal conductivity. Thus, it will accept heat from the helium (if the helium's temperature is higher) and release this heat to the helium (if the helium's temperature is lower).

Figure 5:
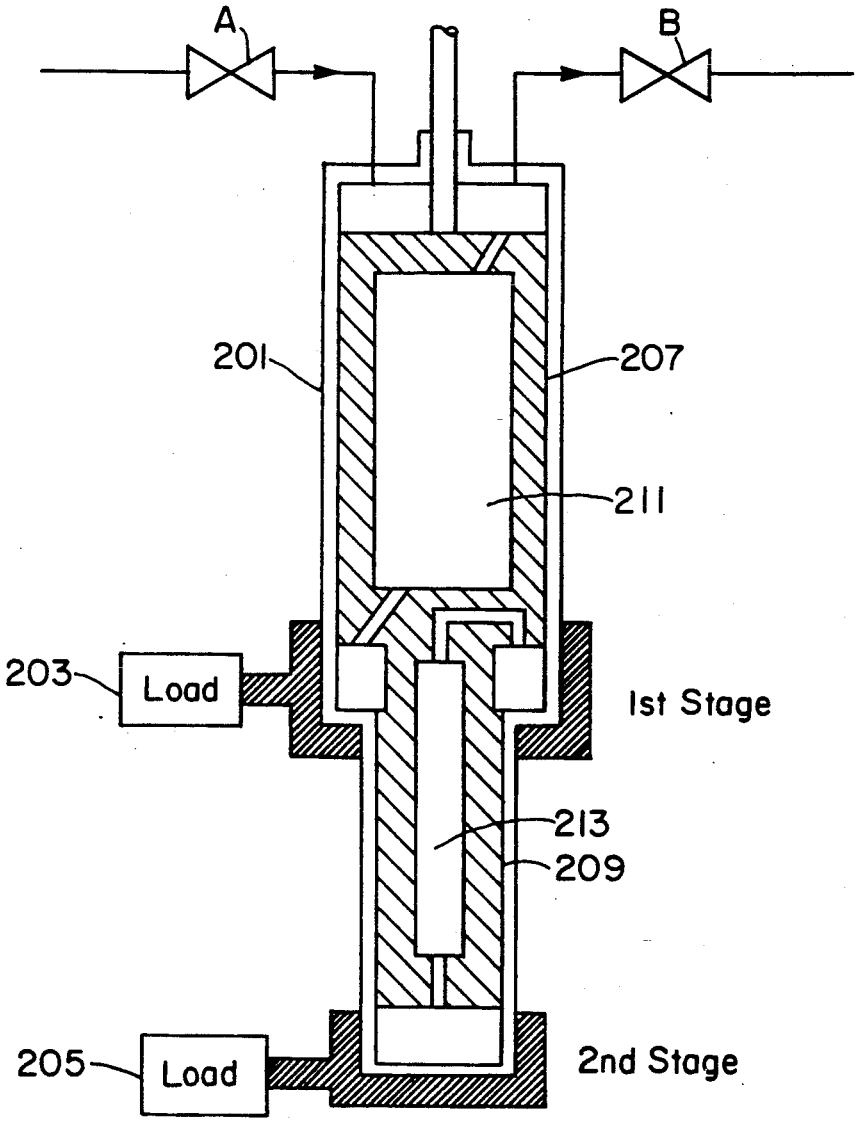
Fig. 5 PRIOR ART
FIG. 5 is a schematic illustration of a conventional closed cycle cryogenic refrigerator of a cryopump.

To achieve temperatures below 10K, a second stage of refrigeration must be added as shown by FIG. 5. In the device of FIG. 5, helium enters the refrigerator through valve A and exits through valve B. The first stage displacer 207 includes a regenerator 211 and second stage displacer 209 includes regenerator 213. Heat is extracted from first stage thermal load 203 and second stage thermal load 205. In a typical cryopump, the first stage load is a radiation shield and the second stage load is a primary pumping surface as described below.

A low temperature second stage, operating at a temperature range of 4 to 25K, is the primary pumping surface. This second stage primary pumping surface is surrounded by a radiation shield which is a higher temperature cylinder, operating at a temperature range of 70 to 130K. The radiation shield comprises a housing which is closed except at a frontal array positioned between the primary pumping surface and the chamber to be evacuated. This higher temperature, first stage, frontal array serves as a pumping site for higher boiling point gases such as water vapor.

In operation, high boiling point gases such as water vapor are condensed on the frontal array. Lower boiling point gases pass through that array and into the volume within the radiation shield and condense on the second stage array. A surface coated with an adsorbent such as charcoal or a molecular sieve operating at or below the temperature of the second stage array may also be provided in this volume to remove the very low boiling point gases. With the gases thus condensed or adsorbed onto the pumping surfaces, only a vacuum remains in the work chamber.

In systems cooled by closed cycle coolers, the cooler is typically a two stage refrigerator as described above having a cold finger which extends through the radiation shield. The cold end of the second, coldest stage of the refrigerator is at the tip of the cold finger. The primary pumping surface, or cryopanel, is connected to a heat sink at the coldest end of the second stage of the cold finger. This cryopanel may be a simple metal plate, a cup or a cylindrical array of metal baffles arranged around and connected to the second stage heat sink. This second stage cryopanel may also support low temperature adsorbent.

The radiation shield is connected to a heat sink, or heat station at the coldest end of the first stage of the refrigerator. The shield surrounds the second stage cryopanel in such a way as to protect it from radiant heat. The frontal array which closes the radiation shield is cooled by the first stage heat sink through the shield or, as disclosed in U.S. Pat. No. 4,356,701, through thermal struts.

As noted previously, "argon hang up" prevents adequate vacuum pressures from being achieved. During normal operation of the system in which the first stage array is held at a temperature of, for example, 77K, argon does not condense on the first stage array but passes directly to the second state array for proper condensation on that array. However, under low thermal load conditions the frontal array temperature can drop to as low as about 40K. At that temperature argon does condense on the frontal array; and at that temperature the partial pressure resulting from the balanced evaporation of solid argon and condensation of argon molecules results in a partial pressure of only $10^{-3}$ to $10^{-4}$ torr. So long as any argon is in this state of sublimation on the frontal array, the pressure in the work chamber cannot be taken down to the desired lower level.

As the argon gas evaporates during sublimation, it eventually migrates to the colder second stage and is captured by that stage. However, the sublimation process is a slow one and until complete the pressure in the system "hangs up" at the higher pressure.

To prevent this problem, a heat load may be provided to the first stage to assure that the first stage is held at a temperature above 50K. For example, U.S. Pat. No. 4,546,613 to Eacobacci et al., incorporated by reference herein, provides a radiation heat load to the first stage so that the heat load is minimized at cooldown temperatures but is significant enough at very low temperatures to prevent the first stage from dropping to a temperature below 50K. Thus, cooldown time is not significantly affected.

Although the frontal array can be held to a sufficiently high temperature to prevent condensation of argon, there is necessarily a continuous temperature gradient along the length of the second stage cylinder between the higher temperature of the first stage and the lower temperature of the second stage. A portion of the cylinder must be within a temperature range which can cause hangup. As a solution to that problem, Eacobacci et al. provided a shield, cooled to the second stage temperature, about the second stage cylinder. That shield captured argon gas so that it could not condense on the cylinder.

However, as noted earlier, even the device of Eacobacci et al. will still experience some argon condensation on the second stage cylinder when the pressure is increased to $10^{-3}$ torr. To then return the pressure to $10^{-8}$ torr, that gas must be released from the cylinder to be condensed at the second stage temperature. To ensure that no argon, oxygen or nitrogen gas condenses on the second stage refrigerator cylinder in accordance with the present invention, a long narrow passageway is arranged between the cold cylinder shield open end and the warmer radiation shield.

Figure 1:
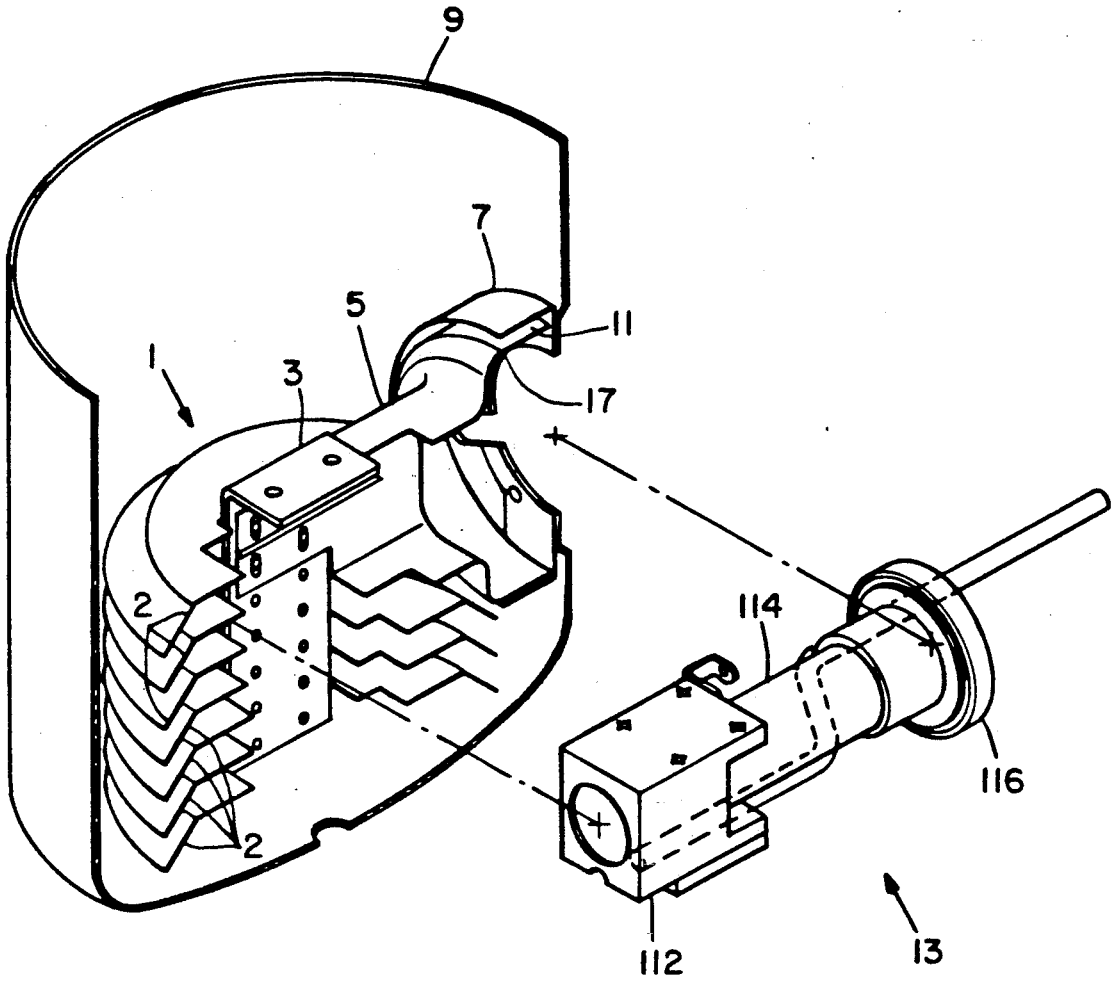
FIG. 1 is a perspective view of a first embodiment of the invention.
Figure 1A:
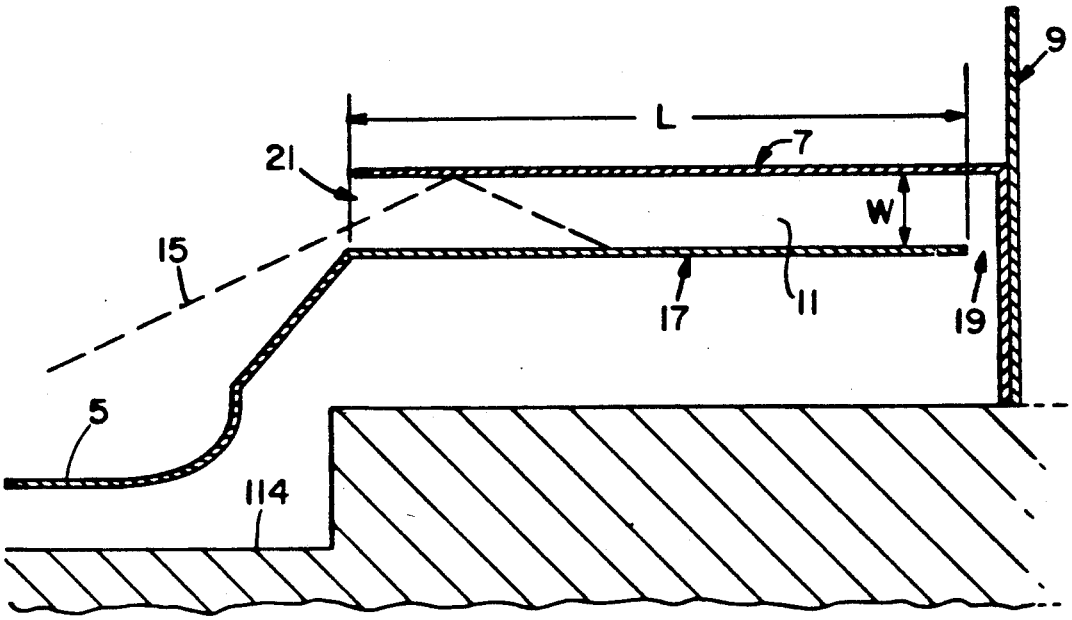
Figure 2:
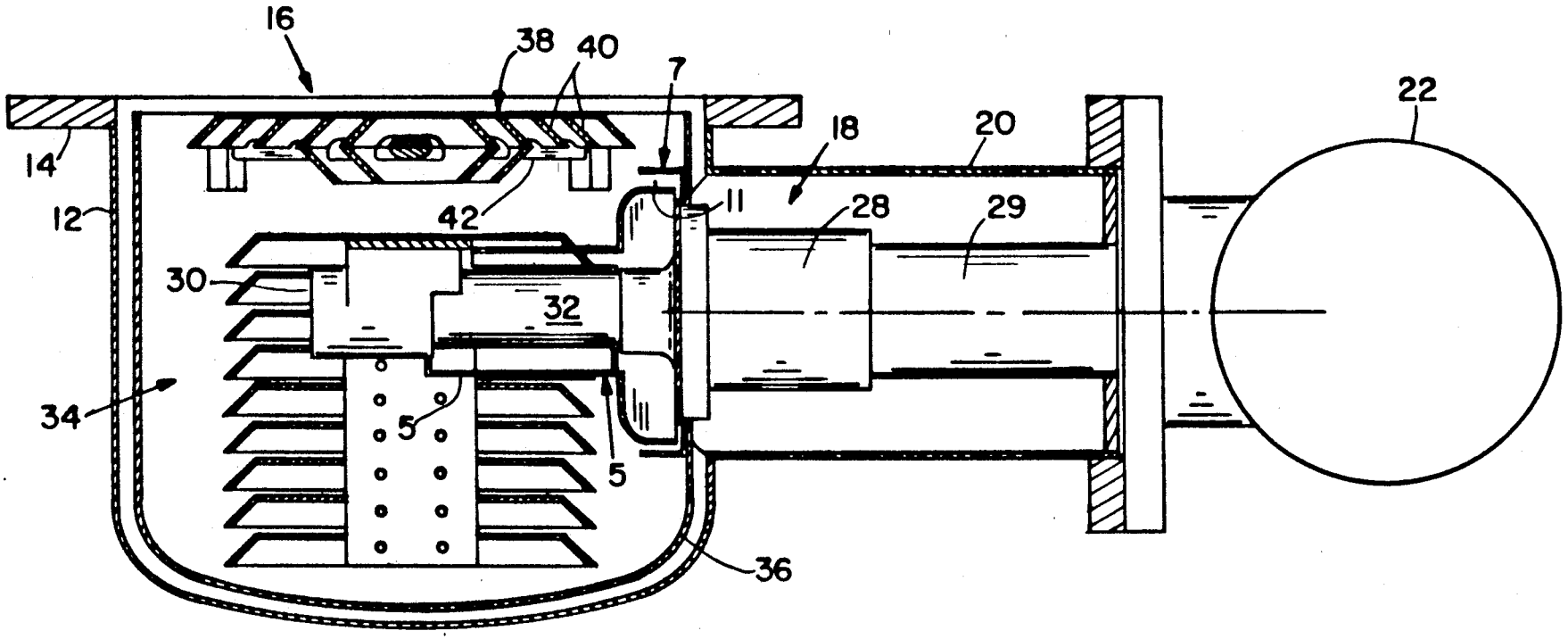
FIG. 2 is a longitudinal cross-sectional view of the embodiment of FIG. 1.

FIGS. 1 and 2 illustrate a preferred embodiment of the invention. The embodiment of FIGS. 1 and 2 is referred to as a "flat" pump in view of the horizontal position of the second stage. FIG. 2 shows a cross-sectional view of a FIG. 1 "flat pump" with the long, narrow passageway of the invention. Conventional "flat pump" cryopumps are disclosed in U.S. Pat. No. 4,555,907 to Bartlett, incorporated by reference herein. Passageway 11 formed between the cylinder shield 5 which thermally contacts the second stage and the cup 7 which thermally contacts the radiation shield prevents gas molecules from reaching and condensing on the second stage 32.

The cryopump of FIG. 2 comprises a vacuum vessel 12 which may be mounted to the wall of a work chamber along a flange 14. The front opening 16 in the vessel 12 communicates with the circular opening in a work chamber. A two stage cold finger 18 of a refrigerator protrudes into the vessel 12 through a cylindrical portion 20 of the vessel 12. In this case, the refrigerator is a Gifford-MacMahon refrigerator such as described above, but others may be used. A two stage displacer in the cold finger 18 is driven by a motor 22. With each cycle, helium gas introduced into the cold finger under pressure is expanded and thus cooled and then exhausted. A first stage heat sink, or heat station, 28 is mounted at the cold end of the first stage 29 of the refrigerator. Similarly, a heat sink 30 is mounted to the cold end of the second stage 32.

A primary pumping surface is an array of baffles 34 mounted to the second stage heat station 30. This array is preferably held at a temperature below 20°K in order to condense low condensing temperature gas. A cup-shaped radiation shield 36 is mounted to the first stage heat station 28. The second stage 32 of the cold finger extends through an opening in the radiation shield. This shield surrounds the second stage array 34 to the rear and sides of the array to minimize heating of the array by radiation. Preferably, the temperature of this radiation shield is less than about 120°K.

A frontal cryopanel array 38 serves as both the radiation shield for the primary cryopanel 34 and as a cryopumping surface for higher boiling temperature gases such as water vapor. This array comprises louvers 40 joined by radial support rods 42. The support rods 42 are mounted to the radiation shield 36. The shield both supports the frontal array and serves as the thermal path from the heat sink 28 to that array.

The operation of the passageway is shown in detail in FIGS. 1 and 1(*a*). The second stage includes a refrigerator cylinder. A second stage plate array 1 comprised of a plurality of baffles 2 is attached to struts 3. The cylinder shield 5 is also attached to the struts 3. Thus, cylinder shield 5 is in thermal contact with the coldest section of the second stage unit 13 comprised of heat sink 112 and cylinder 114. The open end lip 17 of the cylinder shield 5 forms a long narrow passageway 11 in combination with radiation shield cup 7. The radiation shield cup 7 is in thermal contact with the radiation shield 9 which thermally contacts the first stage heat sink 116. Thus, the temperature differential between the cylinder shield 5 and the radiation shield cup 9 is maximized and uniform.

The passageway 11 is formed so that the ratio of the length, L, to the width, W, is ideally greater than or equal to five. At the operating pressure ranges of the cryopump, which are below $10^{-3}$ torr, the gas flow will be molecular. Thus, the gas molecules have large mean free paths. It is unlikely that collisions between gas molecules will occur. The flow will be dominated by collisions with the container walls.

FIG. 1(*a*) illustrates the operation of passageway 11. The long, narrow feature of the passageway ensures that no gas molecules will traverse the passageway opening 19 and enter the area of the cylinder 114. A gas molecule is shown entering the passageway 11 at the opening 21 and traveling along path 15. The gas molecule bounces off the relatively warm wall of cup 7 which is in thermal contact with the radiation shield 9. However, when the gas molecule collides with the wall of the relatively cold cylinder shield (which is in thermal contact with the second stage), condensation occurs. The gas molecules are tightly bound to the cylinder shield. Ideally, a ratio of passageway length to passageway width greater than five ensures that virtually no gas molecules will exit from opening 19 and enter the second stage cylinder region. Since no gas molecules can enter on the second stage cylinder region, condensation on the cylinder and resultant pressure variations are eliminated.

Figure 3:
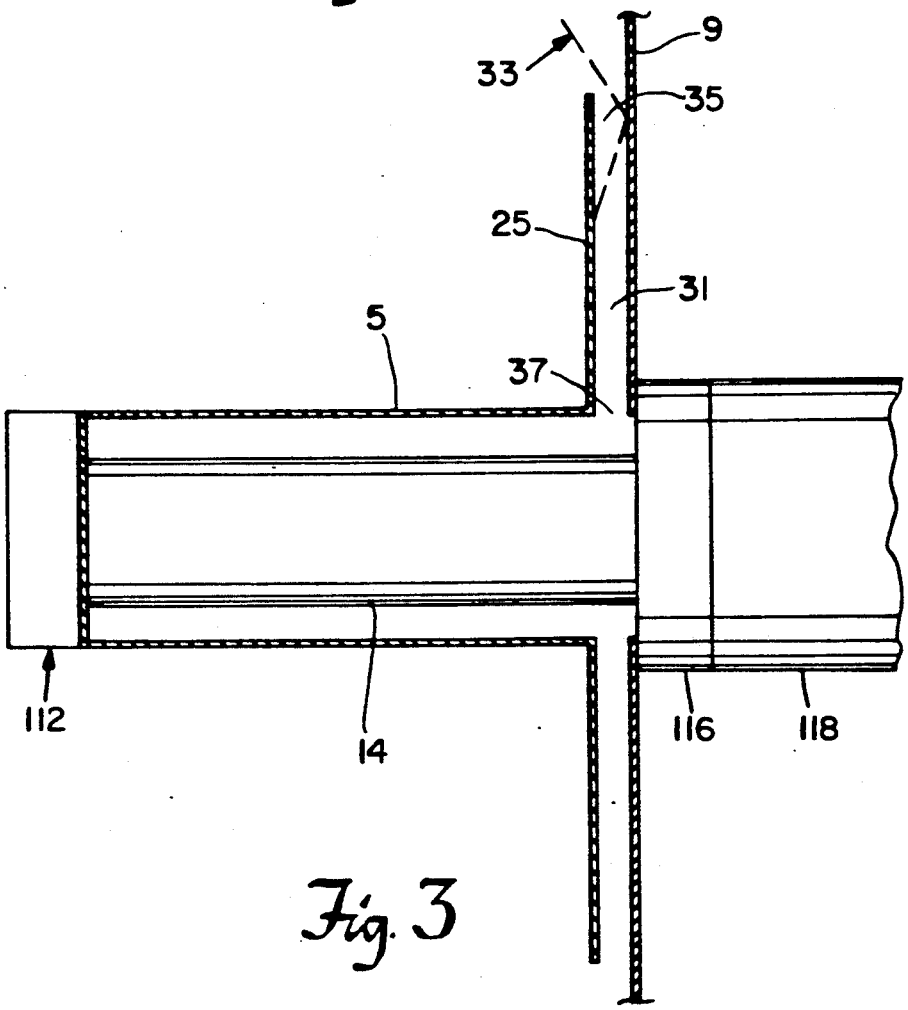
FIG. 3 is a longitudinal cross-sectional view of a second embodiment of the invention.

FIG. 3 illustrates a longitudinal cross sectional view of a flat pump (similar to the cryopump of FIG. 1) with a long, narrow passageway 31 formed by a flared portion 25 of cylinder shield 5 positioned parallel to the wall of radiation shield 9 in thermal contact with the first stage heat sink 116 and cylinder 118. Passageway 31 prevents gas molecules from entering the second stage 13 region of cylinder 114 and heat sink 112. The ratio of the length of the passageway to the width of the passageway is greater than five. This ensures that gas molecules will not enter the second stage area. For example, path 33 shows the progress of a gas molecule as it enters the passageway 31 at opening 35, collides and deflects from the warm wall of radiation shield 9, and finally collides and condenses on the cold wall of flare 25 of the cylinder shield 5. Thus, gas molecules are prevented from entering the second stage area by way of opening 37.

Figure 4:
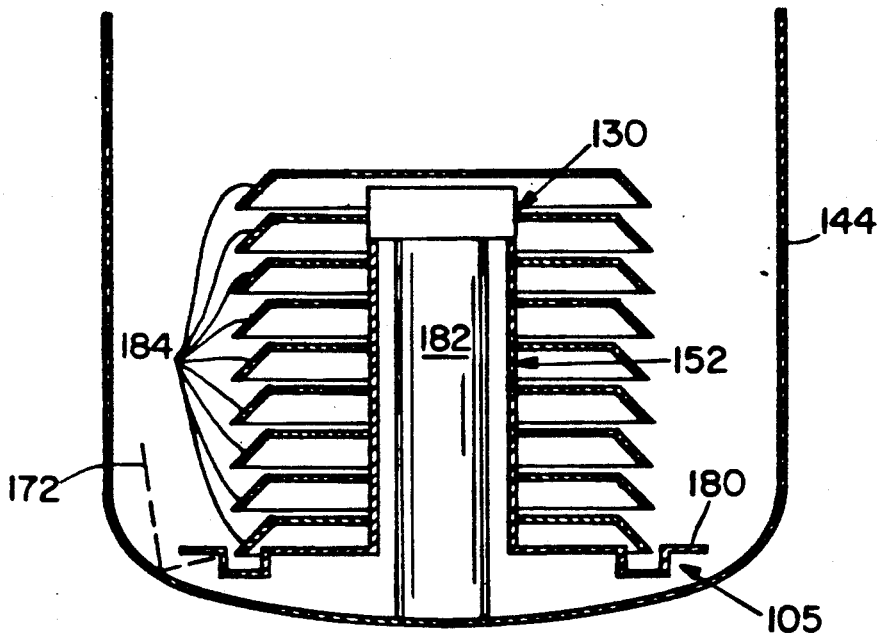
FIG. 4 is a schematic view of a third embodiment of the invention.

FIG. 4 is a schematic illustration of a "straight" pump (or a cryopump with a refrigerator concentric with the radiation shield) with a flared cylinder shield or sleeve. The long narrow passageway formed between the flared cylinder and the radiation shield, again, prevents gas molecules from entering the second stage area.

Baffles 184 form a second stage array. Cylinder 132 is thermally coupled to the second stage heat sink 130. Flared section 180 of shield 152 forms a long narrow passageway with the wall at the bottom of radiation shield 144. Trap 105 further blocks the passage of gas molecules. The ratio of the length of the passageway to the width of the passageway is ideally greater than five. Again, this prevents gas molecules from entering the second stage area of cylinder 182. For example, path 172 shows the direction taken by a gas molecule as it deflects from the warm radiation shield wall to the cold flared cylinder shield wall where it condenses. Thus, gas molecules do not condense on the second stage cylinder. As a result, pressure variations are avoided.

The invention can operate at a pressure range of $10^{-3}$ to $10^{-9}$ torr and lower. Thus, our cryopump can be utilized in sputtering environments of $10^{-3}$ torr, as well as proof clearing environments at $10^{-9}$ torr. By lowering the working chamber pressure to $10^{-9}$ torr, the semiconductor wafer therein is proven clean, i.e. proof cleaned.

While the invention has been particularly shown and described with reference to a preferred embodiment thereof, it will be understood by those skilled in the art that various changes in form and details may be made therein without departing from the spirit and scope of the appended claims. For example, a closed cycle, two stage refrigerator is shown. Combinations of single and two stage closed cycle refrigerators and open cycle refrigerators may be used to provide the cooling. Three or more stages can be used in the cryopump to reach operating temperatures close to 0°K.

We claim:

1. A cryopump comprising:

a refrigerator having at least first and second stages, said second stage including a cylinder, a second stage cylinder shield in thermal contact with the coldest section of the second stage and surrounding the cylinder, a radiation shield which surrounds the second stage and is in thermal contact with the first stage;

a passageway with a uniform temperature differential formed between the cylinder shield and an opposing surface in thermal contact with the radiation shield, the ratio of the length of the passageway relative to its width being greater than or about equal to 5 such that molecular collisions with and condensation on the cold surface of the cylinder shield are assured to tightly bond the gas molecules to the cylinder shield and prevent condensation on the second stage refrigerator cylinder; and a primary pumping surface supporting adsorbent in thermal contact with the second stage, gas flow to the adsorbing surface being unlimited by the passageway.

2. A cryopump, as recited in claim 1, in which the opposing surface further comprises a radiation shield cup which is attached to the radiation shield and extends transverse from the radiation shield such that the open end of the cylinder shield extends parallel to the radiation shield cup and forms the passageway.

3. A cryopump, as recited in claim 1, further comprising a flared open end to the cylinder shield such that the flared end is positioned parallel and adjacent to the radiation shield to form the passageway.

4. A cryopump, comprising a refrigerator having first and second stages including a refrigerator cylinder, a second stage cylinder cryopanel supporting adsorbent material in thermal contact with a heat sink on the second stage to condense and adsorb low condensing temperature gases, a first stage cryopanel in thermal contact with a heat sink on the first stage and held at a temperature higher than the second stage to condense higher condensing temperature gases, a radiation shield surrounding the second stage cryopanel, and a cylinder shield surrounding the second stage refrigerator cylinder with a closed end in thermal contact with the heat sink on the coldest section of the second stage and an open end which forms a passageway with an opposing surface which is in thermal contact with the radiation shield such that L/W is greater than or about equal to 5, where L is the depth of the passageway and W is the width of the passageway, and a uniform temperature differential is formed in said passageway.

5. A cryopump, as recited in claim 4, in which the opposing surface further comprises a radiation shield cup which is attached to the radiation shield and extends transverse from the radiation shield such that the open end of the cylinder shield extends parallel to the radiation shield cup and forms the passageway.

6. The cryopump, as recited in claim 4, further comprising a flared open end to the cylinder shield such that the flared end is positioned parallel and adjacent to the radiation shield to form the passageway.

7. A cryopump comprising:

a refrigerator having a plurality of stages, at least one stage including a cylinder and a concentric cylinder shield;

a radiation shield which surrounds the refrigerator;

a surface which is coupled transverse to the radiation shield;

a passageway formed between the cylinder shield and the surface, the ratio of the length of the passageway to its width being greater than or about equal to 5 such that molecular condensation on the cylinder shield is assured to substantially preclude condensation on the cylinder; and a primary pumping surface supporting adsorbent in thermal contact with the second stage, gas flow to the adsorbing surface being unlimited by the passageway.

8. A cryopump comprising:

a refrigerator having a plurality of stages, at least one stage including a cylinder and a concentric cylinder shield;

a radiation shield which surrounds the refrigerator;

said cylinder shield including an open flared end which extends parallel to the radiation shield forming a passageway, the ratio of the length of the passageway to its width being greater than or about equal to 5 such that molecular condensation on the cylinder shield is assured; and a primary pumping surface supporting adsorbent in thermal contact with the second stage, gas flow to the adsorbing surface being unlimited by the passageway.

9. A cylinder shield for use in a cryopump including a refrigerator having at least first and second stages and a radiation shield which surrounds the second stage and is in thermal contact with the first stage, said second stage including a cylinder, said cylinder shield having a first section for thermal contact with the second stage and for surrounding the cylinder, the improvement comprising:

an elongated second section of the cylinder shield for forming a passageway between the cylinder shield and an opposing surface in thermal contact with the radiation shield, the surface of the cylinder shield forming the passageway being free of adsorbent and the ratio of the length of the passageway to its width being greater than or about equal to 5 such that molecular condensation on the cylinder shield is assured.

10. A cylinder shield, as recited in claim 9, further comprising a flared open end.

11. A cryopump shield, for use in a cryopump including a refrigerator having at least first and second stages including a cylinder, comprising:

a cylinder shield for thermal contact with the second stage and for surrounding the cylinder;

a radiation shield; and said cylinder shield and radiation shield forming a passageway free of adsorbent, the ratio of the length of the passageway to its width being greater than or about equal to 5 such that molecular condensation on the cylinder shield is assured.

* * * * *